US006158376A

United States Patent [19]

Vorus

[11] Patent Number: 6,158,376

[45] Date of Patent: Dec. 12, 2000

[54] SHOCK REDUCTION IN PLANING BOATS

[75] Inventor: William S. Vorus, New Orleans, La.

[73] Assignee: Board of Supervisors of Louisiana State University and Agricultural and Mechanical College, Baton Rouge, La.

[21] Appl. No.: 09/457,829

[22] Filed: Dec. 9, 1999

Related U.S. Application Data

[60] Provisional application No. 60/183,041, Dec. 10, 1998.

[51] Int. Cl.[7] ..... B63B 1/24

[52] U.S. Cl. ..... 114/279; 114/284

[58] Field of Search ..... 114/219, 279, 114/284, 285

[56] References Cited

U.S. PATENT DOCUMENTS 3,270,701 9/1966 Kubas ..... 114/121

FOREIGN PATENT DOCUMENTS 575883 5/1933 Germany ..... 114/284

OTHER PUBLICATIONS

Ando, S., "Cushioning of Slamming Impact by Elastomeric Layers," *J. Ship Res.*, vol. 33, pp. 169–175 (1989).

Gollwitzer, R. et al., "Shock Mitigation on High–Speed Planing Boats," CSS/TR–94–33, pp. 12–13 (Nov. 1994).

Meyerhoff, W., "Die Berechnung hydroelastischer Stösse," Parts I and II, *Schiffstechnik*, vol. 12, pp. 18–30 (1965).

Meyerhoff, W., "Die Berechnung hydroelastischer Stösse," Part III and IV, *Schiffstechnik*, vol. 12, pp. 49–64 (1965).

Vorus, W., "A Flat Cylinder Theory for Vessel Impact and Steady Planing Resistance," *J. Ship Res.*, vol. 40, pp. 89–106 (1996).

Vorus, W. et al., "Shock Reduction of Planing Boats," Appendix J in *Gulf Coast Region Maritime Technology Center Quarterly Report*, Jul.–Sep. 1997 (published Dec. 15, 1997).

Vorus, W. et al., "Shock Reduction of Planing Boats," Appendix J in *Gulf Coast Region Maritime Technology Center Quarterly Report*, Jan.–Mar. 1998.

Vorus, W. et al., "Shock Reduction of Planing Boats," Appendix J in *Gulf Coast Region Maritime Technology Center Quarterly Report*, Apr.–Jun. 1998.

Vorus, W. et al., "Shock Reduction of Planing Boats," Appendix J in *Gulf Coast Region Maritime Technology Center Quarterly Report*, Jul.–Sep. 1998 (not yet published as of the filing date of this application).

Wyman, D. et al., "Gentle Performance Wedge (GPW) Shock Mitigating Planing Boat Hull," United States patent application filed approximately Aug. 8, 1996, serial number currently unknown, Navy case 77536.

Wyman, D., Navy Submission of Invention Disclosure dated Feb. 20, 1990.

*Primary Examiner*—S. Joseph Morano
*Assistant Examiner*—Andrew D. Wright
*Attorney, Agent, or Firm*—John H. Runnels

[57] ABSTRACT

A system is disclosed to reduce the impact shock associated with operating a planing boat at high speeds. The system, called "LocalFlex," comprises an outer bottom placed under the inner bottom of the boat. The outer bottom is spaced a distance from the inner bottom. The outer bottom comprises two plates. Each plate is connected to the inner bottom along or near the keel, and along or near the chine. Along the keel, each plate of the outer bottom is attached to one or more hinges or pins rigidly suspended from or below the keel of the inner bottom. At or near the chine, each plate is connected to the boat by one or more springs. The elastic modulus of the plates and that of the springs are selected so that the outer bottom deforms under the pressure spike of an impact in a whip-like flexure that smoothly directs the pressure spike past the chine. After the spike passes the chine, the pressure diminishes and makes no further significant contribution to impact slamming. Thus impact acceleration can be reduced as much as 50% or more.

15 Claims, 2 Drawing Sheets

SHOCK REDUCTION IN PLANING BOATS

The benefit of the Dec. 10, 1998 filing date of provisional application 60/183,041 (which was a conversion of nonprovisional application 09/209,919) is claimed under 35 U.S.C. § 119(e).

The development of this invention was funded by the Government under cooperative agreement no. N 00014-94-2-0011, awarded by the Office of Naval Research. The Government has certain rights in this invention.

A planing boat achieves lift both from the buoyancy of the boat, and from the dynamic pressure produced on the bottom of the boat due to the boat's motion through the water. As the speed increases, a planing boat rises higher out of the water, its wetted surface decreases, and the rate of increase in drag decreases. However, as speed increases the craft pounds on the water's surface with ever greater acceleration. The problem addressed by the present invention is the operational constraint imposed on planing craft by this wave impact acceleration. Although impact acceleration can be detrimental to the structure of the craft itself, especially over extended periods of time, it is nevertheless the case that from strength and operational points of view planing craft can generally operate in a seaway at higher speeds than are now commonly practiced. The primary limitation on speed is imposed by the inability of human occupants to withstand the shock associated with pounding through waves. Sharp pressure spikes in the region of chine unwetted flow are responsible for the pounding.

FIG. 1 depicts a generic cross section of the bottom of a planing boat. The keel 2 is the line of intersection of the two sides 6 of the bottom. The deadrise angle β is the angle between the bottom 6 of the boat and a horizontal plane 10. The chine 4 is the line of intersection of the bottom of the boat 6 and the side of the boat 8. The deadrise angle generally decreases towards the transom of a planing boat. The decreased deadrise angle reduces resistance, but the flatter hull surface has the side effect of causing increased pounding. As illustrated schematically in FIG. 2, the crucial region for pounding is approximately the mid half 14 of the boat's length, which may be thought of as pivoting about the transom 12 during pounding motion.

There is an unfilled need for hulls with reduced impact acceleration from pounding, without increasing the hull's resistance or drag.

One approach to this problem has been to place strakes (ribs) longitudinally on the hull bottom. Although strakes can reduce impact acceleration somewhat, they do so it the cost of increased resistance and decreased maximum speed. By contrast, it is the goal of the present invention to produce a hull that reduces impact acceleration without increasing resistance, so that the boat's maximum speed is not reduced.

Another approach that has been tried is to mount either the seats or the entire deck of the boat on springs. This approach has had limited effectiveness.

D. Wyman et al., "Gentle Performance Wedge (GPW) Shock Mitigating Planing Boat Hull," United States patent application filed approximately Aug. 8, 1996, serial number currently unknown, Navy case 77536, discloses an apparatus variously known as the "gentle performance wedge" or the "H-step." This apparatus has an outer hull bottom surface element or wedge rotatably connected to the bottom near the bow of the inner hull. The tapered portion of the wedge is hinge-connected at a point near the bow to permit the wedge to rotate downward away from the hull. An airspring is placed between the hull and the wedge at the transom. The operator can modify the configuration and the performance of the hull by altering the pressure of the air in the airspring. The wedge may be lowered for planing and raised for slow speed operation. At planing speeds, the wedge is extended and the airspring absorbs some of the shock of the pounding.

A "variable deadrise hull" is disclosed in D. Wyman, Navy Submission of Invention Disclosure dated Feb. 20, 1990; and in pp. 12–13 of R. Gollwitzer et al., "Shock Mitigation on High-Speed Planing Boats," CSS/TR-94-33 (November 1994). In the variable deadrise hull, a pair of low pressure air bladders are used to allow the operator to alter the deadrise angle of a planing boat. The variable deadrise bottom lies flush against the primary bottom when a deep vee hull shape is desired. When a shallow vee hull is desired, air is injected between the bottoms to extend the variable deadrise bottom downward to form a new shallow vee bottom below the primary bottom. Air is let out of the cavity between the two bottoms when it is desired to use the boat as a deep vee hull again. The variable deadrise hull allows the boat's operator to change from a deep to a shallow vee hull as surface wave conditions change.

S. Ando, "Cushioning of Slamming Impact by Elastomeric Layers," *J. Ship Res.,* vol. 33, pp. 169–175 (1989) discloses the use of an elastomeric layer on the bottom of a hull. As shown in Ando's FIG. 9, the elastomeric layers actually increased impact acceleration for a wedge-shaped bottom. This paper concludes that, in contrast to the results seen for a flat bottom, "when applied to wedge-shaped bottoms, an elastomeric layer tended to increase the maximum impact forces slightly relative to the rigid-bottom impact. The cushioning effect of the elastomeric layer in this case was therefore offset by the increased severity of impact brought about by another effect of the layer's deflection, namely, the concave deformation (or cambering) of the undersurface."

W. Vorus, "A Flat Cylinder Theory for Vessel Impact and Steady Planing Resistance," *J. Ship Res.,* vol. 40, pp. 89–106 (1996) provides a theoretical analysis of the hydrodynamics of impact loads on vessels operating in waves.

I have discovered a system to reduce the impact shock associated with operating a planing boat at high speeds. The system, called "LocalFlex," comprises an outer bottom placed under the inner bottom of the boat. The outer bottom is spaced a distance from the inner bottom, for example a distance of about 6–7% of the width of the boat at the transom. The space between the two bottoms should comprise largely air, although in use it is acceptable if some amount of water spills into this space. There is preferably a layer of snubbing material between the two bottoms. The outer bottom comprises two plates. Each plate is connected by one or more pins or hinges to the inner bottom along or near the keel, and is connected by one or more springs to the inner bottom along or near the chine (the intersection of the boat's bottom and its side). Along the keel, each plate of the outer bottom is attached to a hinge or pin that is rigidly suspended from, preferably a distance below, the keel of the inner bottom. At or near the chine, each plate is connected to the boat by one or more springs, for example by metal springs, air springs, or air bladders.

The elastic modulus of the plates and that of the springs are selected so that the outer bottom deforms under the pressure spike of an impact in a whip-like flexure that smoothly directs the pressure spike past the chine. After the spike passes the chine, the pressure diminishes and makes no further significant contribution to impact slamming. Thus the impact acceleration can be reduced by about 10%, 25%, or as much as 50% or even more as compared to the impact acceleration experienced by a boat with an otherwise identically-shaped, conventional bottom.

When the LocalFlex hull is not being deformed by a pressure spike, its shape conforms to a shape suitable for planing boat hulls generally. The LocalFlex hull responds actively, however, during a slam, modifying its shape in a way that reduces impact acceleration. LocalFlex spreads the slam over a longer period of time, thereby reducing the maximum impact acceleration experienced within the boat.

Figure 1:
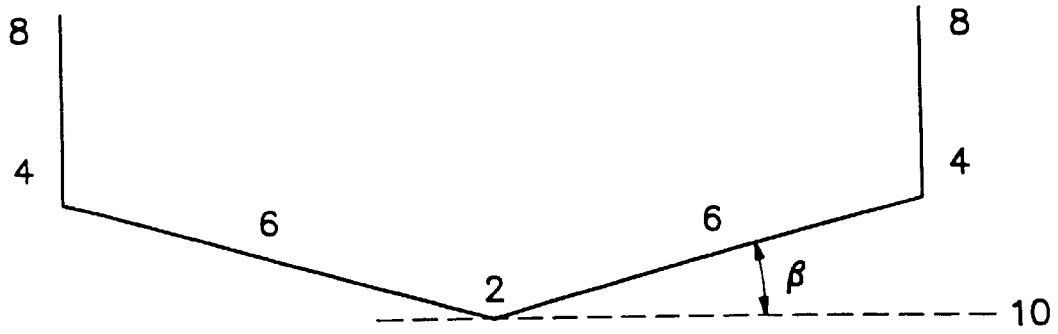
FIG. 1 depicts a generic cross section of the bottom of a planing boat.
Figure 2:
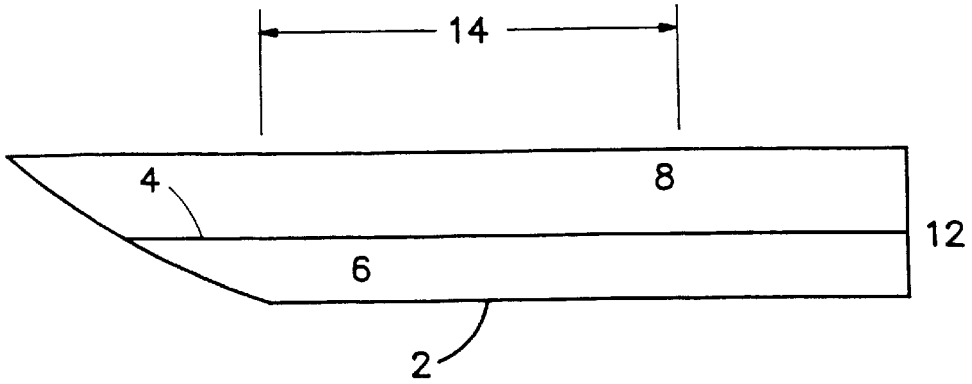
FIG. 2 depicts schematically the crucial region of a boat for slamming acceleration impact.
Figure 3:
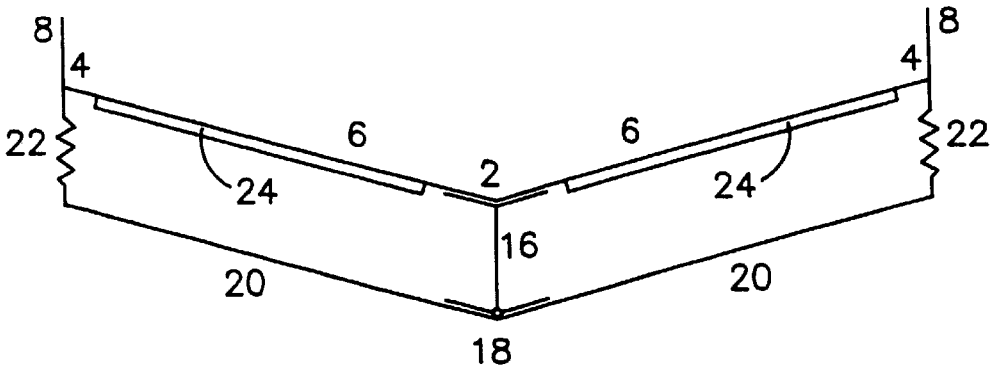
FIG. 3 depicts a schematic illustration of a cross-section of one embodiment of the LocalFlex boat hull.

A schematic illustration of a cross-section of one embodiment of the LocalFlex is shown in FIG. 3. The keel 2 of the inner bottom 6 of the boat is rigidly attached to a yoke 16. At the bottom of yoke 16 is a hinge (or hinges) 18. Hinge 18 is connected to flexible plates 20 forming the outer bottom of the LocalFlex. Springs 22 connect the outer edges of plates 20 to the inner bottom 6 at or near the chine 4. Snubber layer 24 of a relatively soft elastomeric material is placed on the underside of the inner bottom 6 to help absorb shock if the plate 20 deflects upward sufficiently that it would otherwise hit the inner bottom 6. The snubber 24 also helps arrest plate deflection before the plates 20 are overstressed.

Figure 4A:
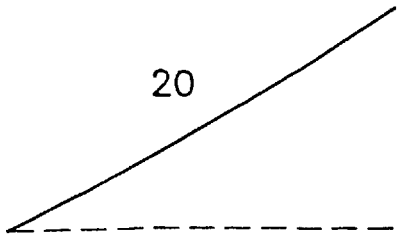
FIGS. 4(*a*) through (*c*) depict sectional views of one plate of a LocalFlex hull over time in response to a pressure spike.
Figure 4B:
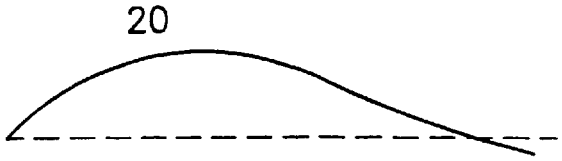
Figure 4C:
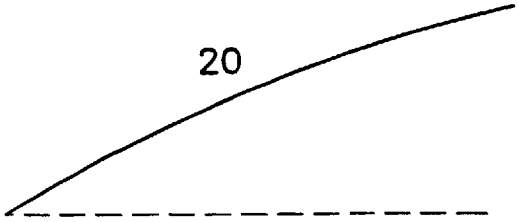

In response to a pressure spike, the plate responds in a manner much like a whip, due to its own elastic modulus and the elastic modulus of its spring support. Sectional views of one plate are shown in FIGS. 4(*a*) through (*c*). FIG. 4(*a*) depicts the conformation of the plate in the absence of a pressure spike. FIG. 4(*b*) depicts the conformation of the plate shortly after the impact of a pressure spike. Note that in the vicinity of the keel, the plate has deformed inwardly, but that the outer edge of the plate actually dips downward initially due to the inertia of and the second vibrational mode of the plate. FIG. 4(*c*) depicts the conformation of the plate at a slightly later time. The pressure pulse has moved towards the chine, and the outer portion of the plate has whipped upward. When the elastic modulus of the plate, the elastomeric modulus of the spring, and the snubber clearance between the inner and outer bottoms are correctly set, although the plate as a whole flexes down and up, the path over time of the point of contact between the pressure spike and the plate is convex, allowing the pressure spike to be transferred more smoothly out past the chine. It is desirable to have one dip, followed by one rise, of the outer edge of the plate before the chine is wetted by the pressure spike (after which the problem of impact acceleration has essentially passed). By contrast, if the path of the point of contact between the pressure spike and the plate includes a concavity, with resulting reduced upward end motion, the effect of the concavity will be to increase the impact acceleration. While small concavities may be acceptable if necessary as design tradeoffs in particular applications, it is preferable that the path over time always be convex where feasible.

The LocalFlex plates are formed of a material that can withstand the slamming pressure and strain experienced by the outer boat bottom. In prototype testing to date, we have used an E-LM fiberglass composite 0.25 inch thick, with a longitudinal elastic modulus of 400,000 psi. (Note that all prototype testing reported in this specification involved testing with models, namely, cylinders that were subjected to drop tests with or without LocalFlex plates, and that prototype testing had not progressed to any testing of actual boats as of the initial priority or filing date of this application.) The plate was made from four layers of E-LM 1210 fiberglass (Johnson Industries Composite Reinforcements, Phoenix, Ala.), laminated to have 40% fiber by weight. This configuration allowed for a relatively low transverse modulus, with a longitudinal modulus two to three times greater than the transverse modulus. The snubbing material on the inner bottom was neoprene sponge rubber. A thicker amount of the same neoprene rubber material was used as the end spring at the chine to provide a spring constant of about 20 psi on contact with the outer bottom.

An initial prototype, made of E-glass having an elastic modulus of 400,000 psi, produced a reduction of about 50% in impact acceleration in cylinder drop tests. The actual performance of the prototype closely matched the predictions of a computer simulation of slamming behavior. The measured impact acceleration fluctuated somewhat over time, however, with small "humps" at oscillations in the 150–200 Hz range. It is believed that the humps were the result of the relatively low elastic modulus used in this prototype, causing the edge of the plate to rebound sooner than it should have, producing a slight concavity in the path of the point of contact between the pressure spike and the plate. In subsequent prototypes, the elastic modulus will be varied sufficiently to essentially remove the "humps" seen with the first prototype. Further prototype testing could use an E-LM fiberglass composite 0.25 inch thick, with an elastic modulus of 1,000,000 psi for the plates; although it is expected that the next prototype to be tested will instead use aluminum plates 0.10 inch thick, each with an elastic modulus of about 10,000,000.

Figure 5:
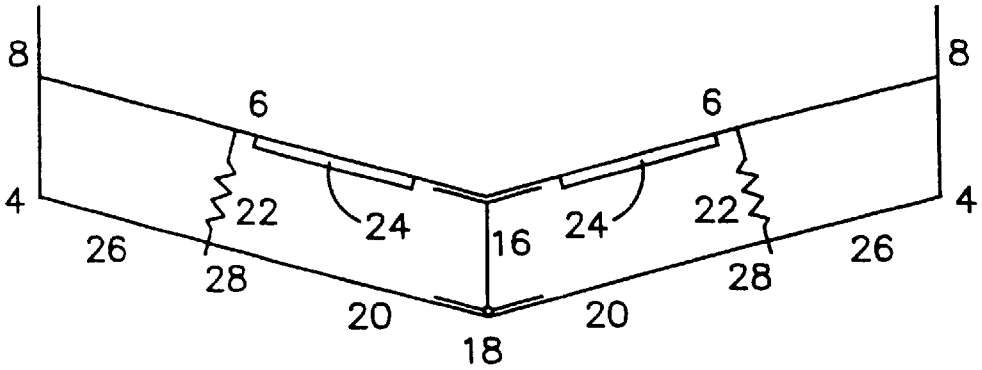
FIG. 5 depicts an alternative embodiment in which a LocalFlex device covers a portion of the space between the keel and the chine.

The configuration described above places the active LocalFlex element along the entire distance between the keel and the chine. In an alternative embodiment, a portion of the boat's outer bottom may be the LocalFlex device, with the remainder being a conventional bottom. The bottom may be partly covered laterally (in section), partly covered longitudinally, or partly covered both laterally and longitudinally with the LocalFlex. For example, as illustrated in FIG. 5, the LocalFlex device might cover about half the space between the keel and the chine, leaving the remainder of the bottom as in a conventional planing boat. As illustrated in FIG. 5, the LocalFlex then produces a "dynamic chine" 28, i.e., the pressure spike separates from the boat towards the end of the LocalFlex; and the remainder of the bottom 26 between the LocalFlex and the "static" chine 4 remains unwetted by the pressure spike. This "dynamic" chine 28 is created by the slam, and mitigates the slam. Such a "dynamic" chine would not be seen during steady planing, only during slamming.

Figure 6:
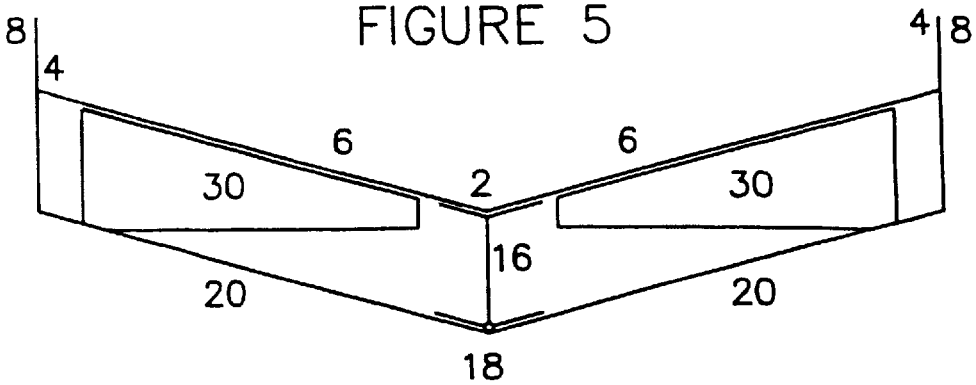
FIG. 6 depicts an alternative embodiment of the LocalFlex boat hull using air bladders.

In an alternative embodiment, the spring or springs may comprise one or more air springs or air bladders between the inner and outer bottoms. As shown in FIG. 6, if this alternative is used, the air bladders 30 may replace both the springs and the snubbing material. The air bladders (formed, for example, of a rubberized material) will be pressurized, for example, with air at a pressure of about 1 to 2 psi, with static clearances reduced from those used in the earlier prototype testing (from about 5% of beam to about 1% or less of beam). The pressure may be set by the operator to achieve the softest ride. Note that, as illustrated in FIG. 6, it is preferred that the air bladders traverse most of the distance between the keel and the chine; and that there is greater clearance between the air bladders and the plates nearer the keel (where the plates undergo the greatest degree of initial flexing).

A computer design model of slamming behavior correlates closely with observed experimental responses of the prototypes tested to date.

The complete disclosures of all references cited in this specification are hereby incorporated by reference. Also incorporated by reference are the full disclosures of the following papers, none of which is prior art to the present application: W. Vorus et al., "Shock Reduction of Planing Boats," Appendix J in *Gulf Coast Region Maritime Technology Center Quarterly Report,* July–September 1997 (published Dec. 15, 1997); W. Vorus et al., "Shock Reduction of Planing Boats," Appendix J in *Gulf Coast Region Maritime Technology Center Quarterly Report,* January–March 1998; W. Vorus et al., "Shock Reduction of Planing Boats," Appendix J in *Gulf Coast Region Maritime Technology Center Quarterly Report,* April–June 1998; W. Vorus et al., "Shock Reduction of Planing Boats," Appendix J in *Gulf Coast Region Maritime Technology Center Quarterly Report,* July–September 1998 (not yet published as of the filing date of this application). In the event of an otherwise irreconcilable conflict, however, the present specification shall control.

I claim:

1. A hull for a planing boat, said hull comprising:

(a) a bottom having a keel;

(b) at least one yoke rigidly attached to and beneath said keel, or rigidly attached to said bottom in the vicinity of said keel;

(c) at least one spring attached to said bottom on the starboard side of said keel, and at least one spring attached to said bottom on the port side of said keel;

(d) at least two plates hingedly attached to said yoke, at least one said plate hingedly attached to said yoke and also attached to at least one said spring on the starboard side of said keel, and at least one said plate hingedly attached to said yoke and also attached to at least one said spring on the port side of said keel; wherein each of said plates is suspended a distance below said bottom by the attachments to said yoke and to said springs; wherein said plates thereby cover at least a portion of said bottom; and wherein the hinged attachment of said plates to said yoke permits said plates to rotate about an axis that is coincident with at least a portion of said keel, or to rotate about an axis that is substantially parallel to at least a portion of said keel; and wherein each of said plates has a deadrise angle greater than zero;

wherein:

(e) the elastic modulus of said plates, the elastic modulus of said springs, and the distance between said bottom and said plates are such that the maximum impact acceleration due to slamming of said hull on the surface of a water body at at least one speed is at least ten percent lower than the maximum impact acceleration due to slamming of a comparison hull on the surface of a water body at the same speed; wherein the comparison hull is substantially identical to said hull, except that the comparison hull lacks said yoke, said springs, and said plates.

2. A hull as recited in claim 1, wherein the elastic modulus of said plates, the elastic modulus of said springs, and the distance between said bottom and said plates are such that the maximum impact acceleration due to slamming of said hull on the surface of a water body at at least one speed is at least twenty-five percent lower than the maximum impact acceleration due to slamming of a comparison hull on the surface of a water body at the same speed; wherein the comparison hull is substantially identical to said hull, except that the comparison hull lacks said yoke, said springs, and said plates.

3. A hull as recited in claim 1, wherein the elastic modulus of said plates, the elastic modulus of said springs, and the distance between said bottom and said plates are such that the maximum impact acceleration due to slamming of said hull on the surface of a water body at at least one speed is at least fifty percent lower than the maximum impact acceleration due to slamming of a comparison hull on the surface of a water body at the same speed; wherein the comparison hull is substantially identical to said hull, except that the comparison hull lacks said yoke, said springs, and said plates.

4. A combination comprising a hull as recited in claim 1, and a layer of a snubber material intermediate said bottom and each of said plates, wherein said snubber material absorbs shock if at least one said plate deflects upward sufficiently that it would otherwise hit said bottom in the absence of said snubber material.

5. A combination as recited in claim 4, wherein said snubber material comprises an elastomeric material.

6. A combination as recited in claim 4, wherein said springs and said snubber material comprise gas bladders formed of an elastomeric material and adapted to contain pressurized gas, wherein at least one said bladder is located intermediate one of said plates and the starboard side of said bottom; and wherein at least one said bladder is located intermediate one of said plates and the port side of said bottom.

7. A combination as recited in claim 6, wherein the shape and position of said bladders is such that the motion of said plates during slamming does not result in contact between said plates and said bladders in the vicinity of said keel.

8. A hull as recited in claim 1, wherein said plates comprise a fiberglass composite.

9. A hull as recited in claim 1, wherein said plates comprise aluminum.

10. A hull as recited in claim 1, wherein said springs comprise air springs.

11. A hull as recited in claim 1, wherein said springs comprise metal springs.

12. A hull as recited in claim 1, wherein said springs comprise an elastomeric material.

13. A hull as recited in claim 1, wherein the planing boat comprises a transom, and wherein the distance between said bottom and said plates is between about 6% and about 7% of the width of the transom.

14. A hull as recited in claim 1, wherein said plates cover only a portion of said bottom laterally; and wherein the size of said plates, the elastic modulus of said plates, the elastic modulus of said springs, and the distance between said bottom and said plates cause the pressure spikes that result from slamming at at least one speed to separate from said hull in the portion of said bottom that is covered by said plates; whereby the pressure spikes do not substantially impact the portion of said bottom that is not covered by said plates.

15. A hull as recited in claim 1, wherein the elastic modulus of said plates, the elastic modulus of said springs, and the distance between said bottom and said plates are such that, at at least one speed, a convex path over time results for the point of contact between a slamming pressure spike and at least one of said plates, whereby the convex path of the point of contact causes the pressure spike to be transferred more smoothly past the chine of said hull than would be the case if the path of the point of contact were concave.

* * * * *